US005930929A

United States Patent [19]

Bubits

[11] Patent Number: 5,930,929

[45] Date of Patent: Aug. 3, 1999

[54] HANDGUN WITH A TRIGGER-SECURING DEVICE

[75] Inventor: Wilhelm Bubits, Brunn/Gebirge, Austria

[73] Assignee: Steyr-Daimler-Puch Aktiengesellschaft, Wien, Austria

[21] Appl. No.: 09/077,901

[22] PCT Filed: Dec. 12, 1996

[86] PCT No.: PCT/AT96/00246

§ 371 Date: Jun. 4, 1998

§ 102(e) Date: Jun. 4, 1998

[87] PCT Pub. No.: WO97/21973

PCT Pub. Date: Jun. 19, 1997

[30] Foreign Application Priority Data

| | | | |
|---|---|---|---|
| Dec. 13, 1995 | [AT] | Austria | 2014/95 |
| Jan. 30, 1996 | [AT] | Austria | 167/96 |
| Jun. 3, 1996 | [AT] | Austria | 954/96 |

[51] Int. Cl.[6] ..... F41A 17/46

[52] U.S. Cl. ..... 42/70.06; 42/70.11

[58] Field of Search ..... 42/70.06, 70.11

[56] References Cited

U.S. PATENT DOCUMENTS

| | | | |
|---|---|---|---|
| 3,715,826 | 2/1973 | Seifried | 42/70.06 |
| 3,735,519 | 5/1973 | Fox | 42/70.11 |
| 4,067,132 | 1/1978 | Smith | 42/70.11 |
| 4,151,670 | 5/1979 | Rath | 42/70.06 |
| 4,391,058 | 7/1983 | Casull | 42/70.06 |
| 4,569,145 | 2/1986 | Ruger et al. | 42/70.06 |

*Primary Examiner*—Charles T. Jordan
*Assistant Examiner*—Denise J Buckley
*Attorney, Agent, or Firm*—Bachman & LaPointe, P.C.

[57] ABSTRACT

A handgun comprises a grip (1), a slide (2), a trigger device (3) having a trigger (10) and a trigger safety lock. In order to provide a simple, ergonomically correct trigger safety lock, this safety lock is formed by a safety locking element (8) which moves vertically above the trigger device (3) in the grip (1), has, at the bottom, a hook (9) which interacts with a catch (11) on the trigger (10), in the safe position, projects visibly out of the grip (1; 60) in front of the trigger (10; 62), and has side projections (15). This safety locking element is held with respect to the grip (1) by a spring-loaded lock (18, 19, 20, 21).

9 Claims, 3 Drawing Sheets

HANDGUN WITH A TRIGGER-SECURING DEVICE

Figure 1:
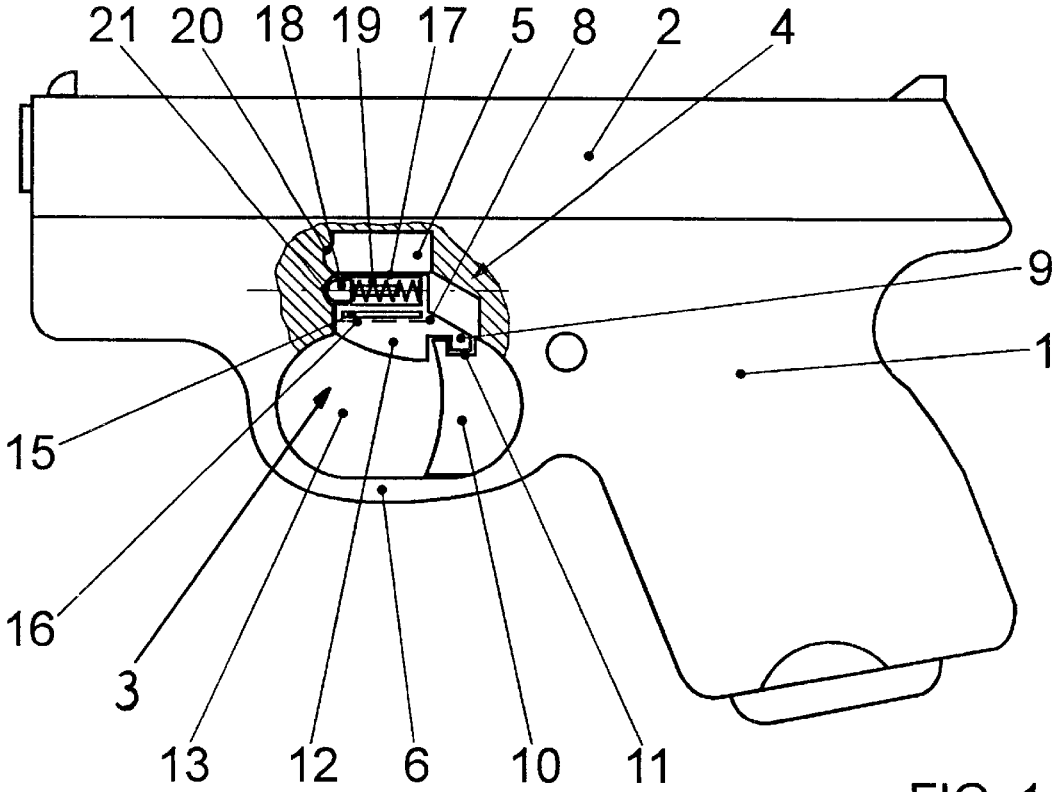

The invention relates to a handgun, comprising a grip, a slide, a trigger device having a trigger and a trigger safety lock. These may be handguns with the capability of switching to rapid fire and machine pistols with triggers of the single action, double action and double action only types, including those with a partially cocked modification. The important factor in the case of such weapons is, to a particularly stringent extent, rapid and simple operation, with maximum safety.

In the case of handguns of this generic type that already exist, the safety lock of the trigger mechanism or of the trigger linkage is located at the side on the rear part of the grip or, generally, is not in the region of the trigger and in most cases is on only one side. This is inconsistent with quick, simple operation.

U.S. Pat. No. 4,471,551 A discloses a safety locking apparatus for rifles, which acts on the firing pin, on the breech action and also on the trigger. In the case of this safety locking apparatus, vertically moving safety locking elements are admittedly arranged above the trigger device. However, owing to the multiple function, this is an apparatus which comprises a large number of parts and is thus susceptible to defects and, owing to the physical height required and the typical trigger apparatus there, is suitable only for rifles. In the case of handguns, any excessive distance between the grip and the barrel axis leads to the weapon tipping upward.

WO 95/16179 discloses a pistol having a trigger safety lock, which has a vertically guided element. Apart from the only indirect relationship between the safety lock and the trigger for kinematic reasons, the arrangement of the safety locking element in front of the trigger guard is impractical since, in fact, this region is used to support the index finger of the supporting hand for two-handed firing. This would result in inadvertent application of the safety lock in the event of two-handed operation. For ergonomic reasons, arming cannot be carried out by forward pressure with the trigger finger, but only by gripping the weapon. In addition, it is impossible to insert the weapon into a holster in the armed state, since it would be made safe again during insertion. This trigger safety lock is thus also inconsistent with quick, simple operation and introduces a risk of operating errors.

The aim of the invention is thus to propose a simple, reliable and ergonomically correct trigger safety lock. In particular, it is intended to be operable equally well by left-handed and right-hand people using the weapon, and with as few actions as possible, and to lie well in the hand when firing as well.

According to the invention, this is achieved by the trigger safety lock being formed by a safety locking element which moves essentially vertically above the trigger device in the grip, which safety locking element, a) has, at the bottom, a hook which, in the safe position, interacts with a catch on the trigger, b) in the safe position, projects visibly out of the grip, in front of the trigger, c) has side projections which are accessible from the outside in both positions, and d) is held, in the locked and in the armed position, with respect to the grip by a spring-loaded lock.

Owing to this method of operation and the shape resulting from it, the physical height required for the safety locking element is only small, so that the vertical distance between the slide and the trigger apparatus is sufficient. By virtue of its arrangement above the trigger apparatus, it can act by means of the hook directly on the trigger irrespective of whether the latter is designed as a horizontally moving slide or as a "tongue". In consequence, the apparatus is particularly simple, and thus cheap and reliable.

That part of the safety locking element which projects in front of the trigger not only indicates the safety status visibly and tactilely, but also satisfies all the ergonomic requirements and allows safe, quick operation. The weapon is armed just by exerting upward pressure with the trigger finger on the lower part of the safety locking element, irrespective of whether this now extends downward or on both sides to the side into the vicinity of the trigger and, immediately after this, the same figure can operate the trigger in a deliberately different movement direction. The side projections, which are accessible from the outside in both positions, allow the weapon to be made safe again with one of the two hands. The spring-loaded lock ensures that the respectively desired position is assumed completely.

The safety locking element can be moved in a straight line in a vertical guide. It can preferably pivot like a rocker about a shaft arranged transversely with respect to the firing direction (claim 2). Owing to the small required travel, the angle change is not perceptible, use however being made of the easy movement of a pivoting mounting.

The lower part of the safety locking element may project out of the grip on both sides but, in the safe position, it preferably projects downward in front of the trigger (claim 3). Thus, the person firing the weapon can immediately sense with his or her trigger finger that the weapon is still safe, and the operating movement is particularly short.

The spring-loaded lock may be accommodated either in the grip or in the safety locking element. In one preferred embodiment, it comprises a bolt which is guided essentially horizontally in the safety locking element and, in both the safe position and the armed position, engages in a recess in the grip (claim 4). It thus occupies no physical space whatsoever.

In a development of the invention, the grip may have upper and lower stops which interact in both positions with the side projections on the safety locking element (claim 5). The side projections may then also at the same time form the lower part of the safety locking element, which is visible and accessible from the outside for arming.

If the safety locking element can pivot like a rocker, ease of operation is assisted if the lower part of the safety locking element becomes lower from front to rear toward the trigger (claim 6). The trigger finger then slides to a certain extent, over the safety locking element.

In the case of a vertically movable safety locking element, it is ergonomically advantageous if the lower part of the safety locking element is in the form of a shell, domed open downward, and its edges facing the barrel nozzle and the trigger extend, running to a point at the edge, into the trigger region (claim 7) or if the lower part of the safety locking element is in the form of a shell, domed open downward, and is rounded on the edge close to the barrel nozzle, and the edge close to the trigger extends, running to a point, into the trigger region (claim 8). In this way, the trigger finger easily moves to the optimum position for arming.

In a particularly advantageous development, the entire trigger device, including a trigger guard, is arranged inclined downward with respect to the firing direction (claim 9). This not only further reduces the horizontal distance between the slide and the trigger apparatus, which counteracts any sudden upward movement of the weapon during firing, but it also ergonomically takes account of the natural tendency of a person firing the weapon to point the index finger of the hand, which is held loosely at the firing level, slightly downward.

Figure 2:
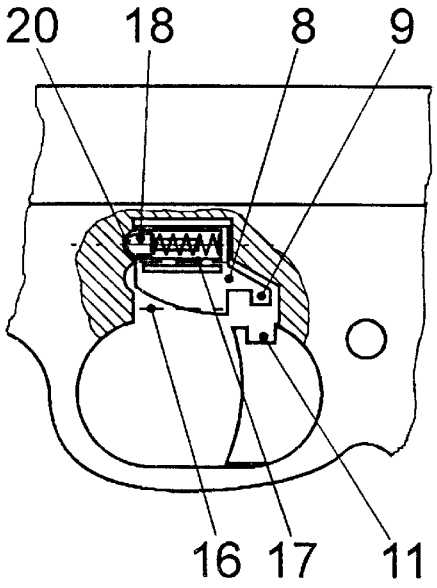
Figure 3:
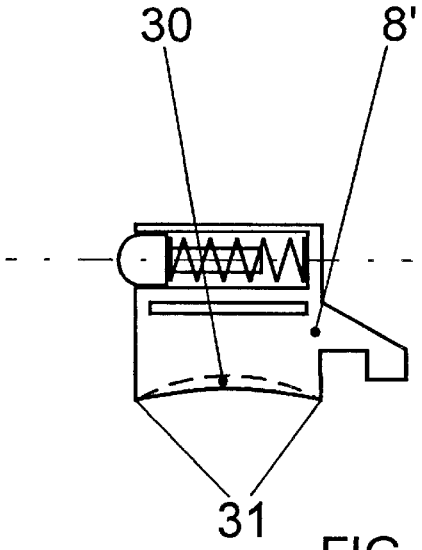
Figure 4:
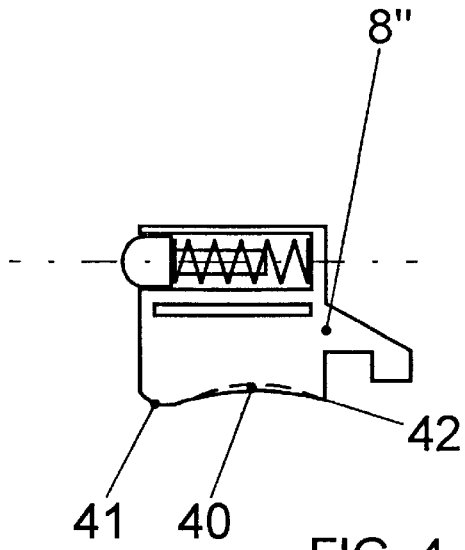
Figure 5:
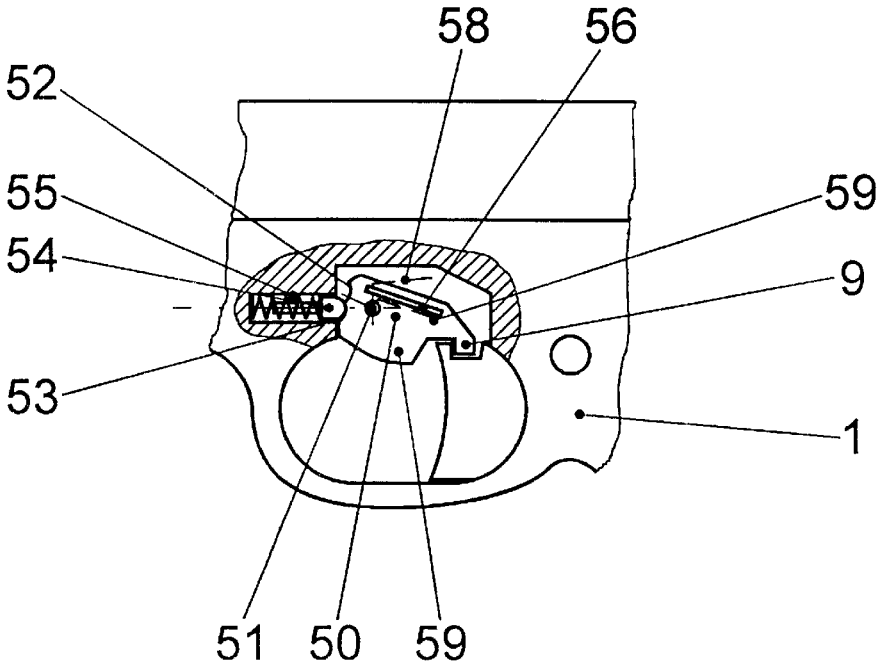
Figure 6:
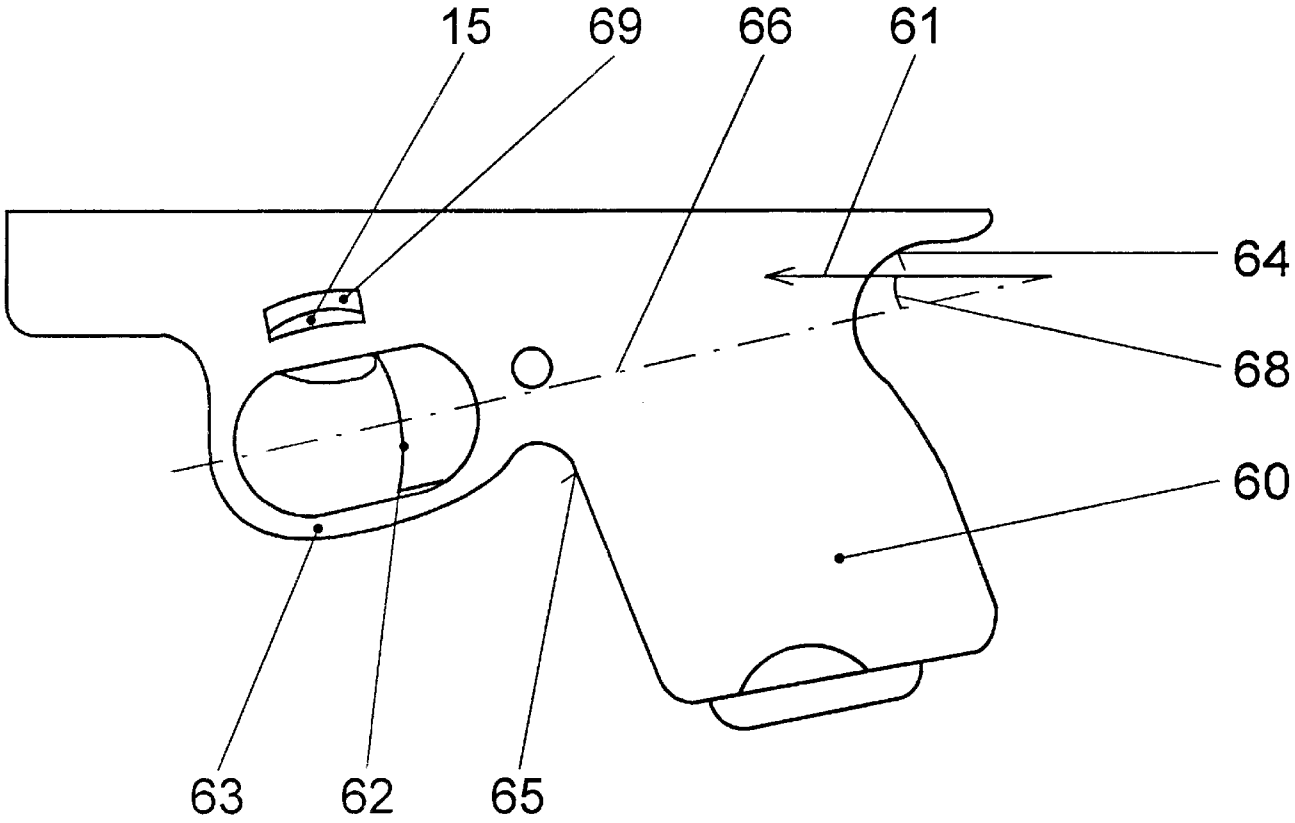

The invention will be described and explained in the following text with reference to illustrations, in which:

FIG. 1: shows a side view of a first embodiment of a pistol according to the invention, partially cut away;

FIG. 2: shows a view as in FIG. 1, but in a different position;

FIG. 3: shows a first variation of a detail from FIG. 1;

FIG. 4: shows a second variation of a detail from FIG. 1;

FIG. 5: shows a side view of a second embodiment of a pistol according to the invention, partially cut away;

FIG. 6: shows a side view of a third embodiment of a pistol according to the invention.

In FIG. 1, the grip is designated as 1. A slide 2 is guided in a known manner on said grip such that it can move. A trigger device 3 is provided in the center on the underneath of the grip 1 and, above this trigger device 3, a trigger safety lock which is designated overall as 4 is provided. A vertical shaft 5 is provided for this trigger safety lock 4, in the interior of the grip 1. A trigger guard 6 is part of the grip.

The trigger safety lock 4 essentially comprises only a safety locking element 8. In its rear, lower part, this safety locking element 8 has an extension which forms a hook 9. In the safe position illustrated, this hook 9 engages in a catch 11 of the trigger 10 which, in this case, is a horizontally guided slide. In front of the hook 9, the safety locking element 8 forms a lower part 12, which may be painted red, and which projects visibly into the trigger region 13 in the safe position illustrated. However, it can also be sensed by touch, so that the person firing the weapon can identify the safe status even in the dark.

The safety locking element 8 is furthermore provided with side projections 15, which are accessible from the outside on both sides. Apertures (which are not illustrated) can be provided in the grip 1, for this purpose. These apertures form lower stops 16 and upper stops 17 which limit the movement of the safety locking element 8 in the safe position and in the armed position. A bolt 18 is guided in a hole (which is not illustrated) in the interior of the safety locking element 8, is pressed outward by a spring 19 and latches in the recess 20 in the grip 1 in the armed position, and in the recess 21 in the grip 1 in the safe position.

FIG. 2 shows the same weapon in the armed position. The safety locking element 8 is raised to such an extent that the hook 9 releases the catch 11, and the bolt 18 latches in the recess 20.

FIG. 3 shows only the safety locking element 8', in a modified state. A shell 30 is provided instead of the lower part 12 (FIG. 1) which becomes lower in an inclined manner toward the trigger, and the trigger finger of the person firing the weapon easily finds its way into this shell 30. This shell ends in a sharp edge 31 at both the front and rear. In FIG. 4, the safety locking element 8" has a somewhat differently shaped shell 40, which merges into a chamfer 41 at the front and has a sharp edge 42 at the rear.

FIG. 5 shows an embodiment in which a safety locking element 50 can pivot about a shaft 51 arranged transversely with respect to the firing direction. Owing to the elongated shape of the safety locking element 50 and the small travel required, this also results in an approximately vertical movement. The spring-loaded bolt 54 of the lock is in this case introduced into a hole 55 in the grip 1 and engages in recesses 52, 53 in the safety locking element 50. The recess 55 corresponds to the safe state of the weapon. With the recesses 52, 53 having a suitable shape, the bolt 54 ensures that the safety locking element 50 is located in only one of the two recesses and cannot assume an intermediate position. The side projections 56, which are also used to make the weapon safe here and are thus accessible from the outside, are allocated stops 57, 58 which are not parallel, in accordance with the pivoting movement.

FIG. 6 shows a further variant in which the grip is shaped such that there is an angle 68 of about 15 to 25 degrees between the firing direction 61 and the trigger direction 66. A trigger 62 is in this case designed as a classic "tongue". It can be seen that the grip 60 is shaped such that the trigger device, which comprises the trigger 62 and the trigger guard 63, is inclined downward through the angle 68. In a corresponding manner, the grip 60 also has a shaped recess 64 for the ball of the thumb and a shaped recess 65 for the middle finger, which likewise point downward. This design allows the weapon to be held without effort with the trigger finger pointing slightly downward and, in addition, reduces the height difference between the shaped recess for the ball of the thumb and the barrel axis (which is not illustrated). This prevents the weapon from moving suddenly upward when firing.

Overall, this provides a simple, reliable trigger safety lock and, furthermore, takes account of all the ergonomic requirements.

I claim:

1. A handgun, comprising a grip (1), a slide (2), a trigger device (3) having a trigger (10) and a trigger safety lock, wherein the trigger safety lock (4) is formed by a safety locking element (8; 50) movable between a safe position and an armed position essentially vertically above the trigger device (3) in the grip (1), which safety locking element, a) has, at the bottom, a hook (9) which, in the safe position, interacts with a catch (11) on the trigger (10; 62), b) in the safe position, projects visibly out of the grip (1; 60), in front of the trigger (10; 62), c) has side projections (15) which are accessible from the outside when in either position, and d) is held, in the safe position and in the armed position, with respect to the grip (1; 60) by a spring-loaded lock (18, 19, 20, 21; 52, 53, 54, 55).

2. The handgun having a trigger safety lock as claimed in claim 1, wherein the safety locking element (50) can pivot like a rocker about a shaft (51) arranged transversely with respect to the firing direction.

3. The handgun having a trigger safety lock as claimed in claim 1, wherein, in the safe position, a part (12) of the safety locking element (8; 50) projects downward out of the grip (1; 60), in front of the trigger (10; 62), such that it is visible.

4. The handgun having a trigger safety lock as claimed in claim 1, wherein the spring-loaded lock comprises a bolt (18) which is guided essentially horizontally in the safety locking element and, in both the safe position and the armed position, engages in a recess (20, 21) in the grip (1).

5. The handgun having a trigger safety lock as claimed in claim 1, wherein the grip (1) has upper and lower stops (16, 17; 57, 58) which interact in both positions with the side projections (15; 56) on the safety locking element (8; 50).

6. The handgun having a trigger safety lock as claimed in claim 2, wherein a lower part (12) of the safety locking element (8) becomes lower from front to rear toward the trigger (10).

7. The handgun having a trigger safety lock as claimed in claim 1, wherein a lower part of the safety locking element forms a shell (30) which is domed open downward and whose edges (31) facing a barrel nozzle and the trigger extend, running to a point at an edge, into the trigger region (13).

8. The handgun having a trigger safety lock as claimed in claim 1, wherein a lower part of the safety locking element forms a shell (40), is domed open downward and has a chamfer (41) on the side close to a barrel nozzle, and an edge (42) close to the trigger extends, running to a point, into the trigger region (13).

9. The handgun having a trigger safety lock as claimed in claim 1, wherein the trigger device (66), including a trigger guard (63), is arranged inclined downward through an angle (68) with respect to the firing direction (61).

* * * * *